US010618239B2

(12) United States Patent
Wetsch et al.

(10) Patent No.: US 10,618,239 B2
(45) Date of Patent: Apr. 14, 2020

(54) TEAR-ASSIST BLADE

(71) Applicant: Pregis Innovative Packaging LLC, Deerfield, IL (US)

(72) Inventors: Thomas D. Wetsch, St. Charles, IL (US); Robert Tegel, Huntley, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 0 days.

(21) Appl. No.: 15/284,836

(22) Filed: Oct. 4, 2016

(65) Prior Publication Data

US 2017/0021585 A1 Jan. 26, 2017

Related U.S. Application Data

(62) Division of application No. 13/843,917, filed on Mar. 15, 2013, now Pat. No. 9,457,982.

(51) Int. Cl.
*B31D 5/00* (2017.01)
*B65H 35/04* (2006.01)
(Continued)

(52) U.S. Cl.
CPC ..... *B31D 5/0043* (2013.01); *B26F 3/02* (2013.01); *B65H 20/26* (2013.01); *B65H 35/008* (2013.01);
(Continued)

(58) Field of Classification Search
CPC .. B65H 35/008; B65H 35/00; B65H 35/0006; B65H 35/002; B65H 35/0073; B65H 35/02; B65H 35/04; B65H 20/26; B65H 45/06; B26F 3/02; B26F 3/00; B26F 3/002; Y10T 225/20; Y10T 225/203;
(Continued)

(56) References Cited

U.S. PATENT DOCUMENTS 2,872,263 A 2/1959 Andersson
3,542,268 A 11/1970 Schramm
(Continued)

FOREIGN PATENT DOCUMENTS

CN 2054447 3/1990
CN 2221580 3/1996
(Continued)

OTHER PUBLICATIONS

First Office Action of the State Intellectual Property Office of the People's Republic of China, China Search Report dated Sep. 20, 2016 for International Application No. 201480025200.0, (4 pages).
(Continued)

*Primary Examiner* — Phong H Nguyen
(74) *Attorney, Agent, or Firm* — Fox Rothschild LLP

(57) ABSTRACT

A material dispenser having a dispensing member configured to dispense a line of the material along a path in a downstream direction, and a cutting member having a cutting edge extending generally downstream with respect to the path. The cutting member having a convex shape across the path, such that the cutting edge engages and sequentially initiates cuts through the line of material when the line of material is pulled against the cutting member, thereby minimize cutting forces.

21 Claims, 13 Drawing Sheets

(51) Int. Cl.

| | |
|---|---|
| ***B65H 35/00*** | (2006.01) |
| ***B65H 20/26*** | (2006.01) |
| ***B26F 3/02*** | (2006.01) |
| ***B65H 45/06*** | (2006.01) |

(52) U.S. Cl.
CPC ..... *B65H 35/04* (2013.01); *B65H 45/06* (2013.01); *B31D 2205/0029* (2013.01); *B31D 2205/0058* (2013.01); *B31D 2205/0088* (2013.01); *B65H 2801/63* (2013.01); *Y10T 225/298* (2015.04)

(58) Field of Classification Search
CPC ..... Y10T 225/257; Y10T 225/261; Y10T 225/282; Y10T 225/284; Y10T 225/30; Y10T 225/298; B31D 5/0043; B31D 2205/0029; B31D 2205/0058; B31D 2205/0088; B31D 2801/63
See application file for complete search history.

(56) References Cited

U.S. PATENT DOCUMENTS

| | | | | |
|---|---|---|---|---|
| 4,426,029 | A * | 1/1984 | Kamp | 225/49 |
| 4,699,609 | A | 10/1987 | Komaransky et al. | |
| 5,370,916 | A | 12/1994 | Olsen | |
| 6,176,409 | B1 | 1/2001 | Lee et al. | |
| 6,910,997 | B1 | 6/2005 | Yampolsky et al. | |
| 7,407,471 | B2 | 8/2008 | Demers et al. | |
| 8,016,735 | B2 | 9/2011 | Wetsch et al. | |
| 2004/0127341 | A1 | 7/2004 | Kung et al. | |
| 2008/0076653 | A1 | 3/2008 | Shaw et al. | |
| 2008/0169301 | A1 | 4/2008 | Mok et al. | |
| 2008/0261794 | A1 | 10/2008 | Slovencik et al. | |
| 2009/0026306 | A1 | 1/2009 | Kempster et al. | |
| 2011/0052875 | A1 | 3/2011 | Wetsch et al. | |
| 2012/0165172 | A1 | 6/2012 | Wetsch et al. | |

FOREIGN PATENT DOCUMENTS

| | | | |
|---|---|---|---|
| CN | 200957989 | | 10/2007 |
| FR | 2796055 | B1 | 9/2001 |
| GB | 940626 | A | 10/1963 |
| WO | 2005/007394 | A2 | 1/2005 |
| WO | 2006/047696 | A2 | 5/2006 |
| WO | 2006/087511 | A1 | 8/2006 |
| WO | 2012/088521 | A2 | 6/2012 |

OTHER PUBLICATIONS

PCT International Search Report and Written Opinion, PCT International Search Report and Written Opinion dated Jul. 8, 2014 for International Application No. PCT/US2014/030266, (15 pages).
European Patent Office Communication pursuant to Article 94(3) dated Jul. 3, 2017, in European Application No. 14 762 483.7, 6 pages.

* cited by examiner

TEAR-ASSIST BLADE

CROSS REFERENCE TO RELATED APPLICATIONS

This application is a divisional of U.S. patent application Ser. No. 13/843,917 filed Mar. 15, 2013, and entitled "Tear-Assist Blade," the contents of which are incorporated by reference in their entirety.

TECHNICAL FIELD

An apparatus for processing a line of material is disclosed. More particularly, an apparatus for assisting a user in tearing the line of material at a desired point therealong is disclosed.

BACKGROUND

In the context of paper-based protective packaging, rolls of paper sheet are crumpled to produce the dunnage. Most commonly, this type of dunnage is created by running a generally continuous strip of paper into a dunnage conversion machine that converts a compact supply of stock material, such as a roll or stack of paper, into a lower density dunnage material. The continuous strip of crumpled sheet material may be cut into desired lengths to effectively fill void space within a container holding a product. The dunnage material may be produced on an as needed basis for a packer. Examples of cushioning product machines that feed a paper sheet from an innermost location of a roll are described in U.S. Patent Publication Nos. 2008/0076653 and 2008/0261794. Another example of a cushioning product machine is described in U.S. Patent Publication No. 2009/0026306.

At a selected point along the processed line of material, a user may wish to sever the line so as to separate the line into two or more portions. Existing processing systems require the user to pull the line against a cutting member in order to sever a portion therefrom. Such pulling requires the user to exert a force against the line.

U.S. Pat. No. 7,407,471 discloses a device with two restraining members that close on a strip of dunnage to grip the strip while the a feeding assembly operates in reverse to tear the strip.

It would therefore be desirable to employ a line processing apparatus and system with a tear-assist apparatus. In particular, it would be desirable to employ an apparatus that lessens the force required of a user to sever a processed line of material at a desired point.

SUMMARY

In some embodiments, a material dispenser can comprise a dispensing member configured to dispense a line of the material along a path in a downstream direction and a cutting member. The cutting member can have a cutting edge extending generally downstream with respect to the path and can have a convex shape across the path such that the cutting edge engages and sequentially initiates cuts through the line of material when the line of material is pulled against the cutting member, thereby reducing cutting forces. The cutting member can further comprise cutting elements on the cutting edge extending generally downstream with respect to the path and can be arranged with respect to each other along the convex cutting edge. The cutting member can comprise a blade that can have a blade flat that extends generally downstream along the path and terminating on a downstream side thereof at the cutting elements. The blade flat can have a substantially flat surface. In some embodiments, the convex shape is an arc.

In some embodiments, the cutting edge can be serrated and the cutting elements can comprise tips of the serrations.

In some embodiment, the blade can be pivotable about a blade axis that extends generally transverse to the path such that the pulling of the line of material against the cutting elements displaces the blade about the blade axis. The material dispenser can further comprise a tear-assist unit that can be operable to pull the line of material against the cutting member to initiate the cuts and a sensing unit that can be configured to detect the displacement of the blade about the blade axis and associated with the tear-assist unit to trigger the tear-assist unit to drive the line of material in a reverse direction along the path against the cutting member to initiate a tear in the line of material.

The material dispenser, in some embodiments, can further comprise a tear-assist unit can be that operable to pull the line of material against the cutting member to initiate the cuts. In some embodiments, the tear-assist unit can be operable to pull the line of material upstream with respect to the path against the cutting member to initiate the cuts. The tear-assist unit can comprise a dispensing member and can be operable in reverse to pull the material upstream. The dispensing member can comprise a converting station that can be operable to convert supply material into the line of material as low-density dunnage, the tear-assist unit, dispensing member, and converting station comprise a drum that is operable for dispensing a line of material, converting a line of material into low-density dunnage, and pulling the line of material upstream with respect to the path against the cutting member to initiate cuts.

Some embodiments can further comprise a sensing unit that can be configured to detect a pulling of the line of material by a user in a predetermined direction. The sensing unit can be associated with the tear-assist unit such that upon detection of the pulling of the line of material by the user against the cutting member, the sensing unit triggers the tear-assist unit to drive the line of material in a reverse direction along the path against the cutting member to initiate a tear in the line of material. The sensing unit can comprise a switch sensitive the displacement of the cutting unit indicative of a user pulling on the material against the cutting unit. In some embodiments, the sensing unit can be configured to detect the movement of the drum in the forward direction by the pulling of the line of material by the user, and upon detection, triggers the tear-assist unit to drive the line of material in a reverse direction along the path against the cutting member to initiate a tear in the line of material.

In some embodiments, the line of material can comprise of a line of dunnage.

The dispensing member, in some embodiments, can comprise a converting station that can be operable to convert supply material into the line of material as low-density dunnage, and the line of material is ribbon of paper sheet material. In some embodiments, the converting station can be configured for longitudinally creasing the supply material to convert the supply material into the dunnage. The tear-assist unit can be operable in a reverse direction for pulling the dunnage against the cutting member to cause the cutting member to cut the dunnage when the dunnage is pulled against the cutting member.

The blade in some configurations can comprise teeth having tips spaced from each other and positioned along the convex shape to sequentially engage the material pulled thereagainst. The cutting elements can be spaced from each other so that when a user grips and pulls the line of material against the cutting member, the line of material initially contacts an initial group of the number of cutting elements that face the material, and contacts additional ones of the cutting elements once the initial group has initiated cutting the material.

In some embodiments, a dunnage apparatus can comprise a converting station that can converts a line of material into dunnage and dispenses the dunnage along a path in a downstream direction, and a tear-assist apparatus that can comprise a cutting member having cutting elements extending generally downstream with respect to the path and arranged with respect to each other along a convex shape across the path, such that the cutting edge engages and sequentially initiates cuts through the line of material when the line of material is pulled against the cutting member, thereby reducing cutting forces, the tear-assist apparatus configured to operably pull the line of material upstream against the cutting members to initiate the cuts. The tear-assist unit and converting station can comprise a drum that is operable for dispensing a line of material, converting a line of material into low-density dunnage, and pulling the line of material upstream with respect to the path against the cutting member to initiate the cuts.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION OF PREFERRED EMBODIMENTS

An apparatus for processing a line of material is disclosed. More particularly, an apparatus for assisting a user in tearing or otherwise breaking off or detaching a portion from the line of material at a desired point therealong is disclosed. The present disclosure is generally applicable to systems and apparatus where supply material, preferably being a line of material, is processed. In an example system, the line of material originates from a source repository, where the line of material is stored in a roll (whether drawn from inside or outside the roll), a wind, a fan-folded source, or another suitable form. In one embodiment, the line of material can be perforated. The line of material is then processed, which can include driving the line of material in an output direction, such as a dispensing direction. In one example system, the line of material is fed from the repository through a drive roller in a dispensing direction, which is further discussed below, so as to dispense the line of material in said direction. The supply material can also be other types of protective packaging including other dunnage and void fill materials, and inflatable packaging pillows. A particular application of the apparatus described herein is the processing of dunnage material for packaging. Other applications can also be used, including lines of other paper or fiber-based materials in sheet form, lines of wound fiber material such as ropes or thread, and lines of thermoplastic materials such as a web of plastic material usable to form pillow packaging material.

Figure 1:
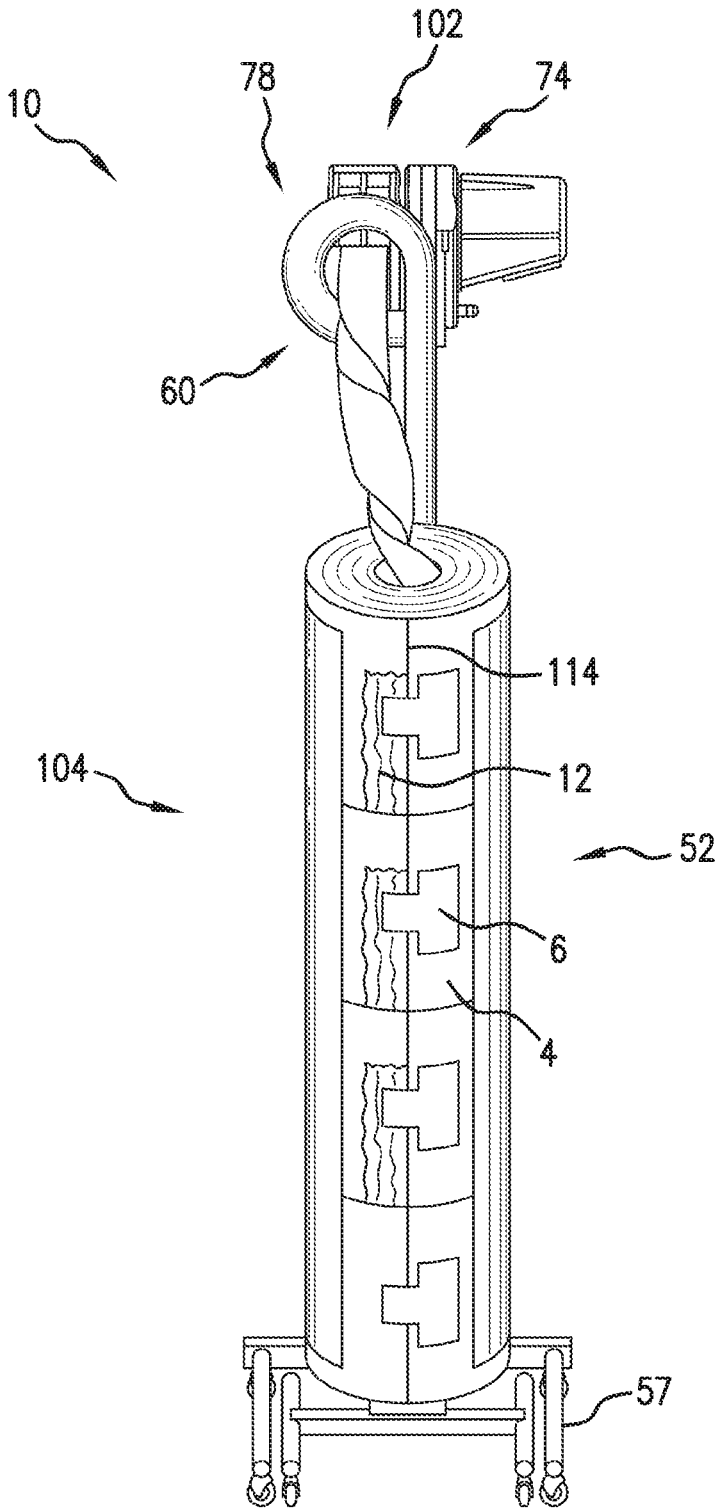
FIG. 1 is the rear view of a line processing system and supply station constructed in accordance with the present disclosure.

FIG. 1 depicts one embodiment of the system 10. In this embodiment, the system 10 is configured to pull a continuous stream of supply material, preferably a line of material 19, from a supply station 104. The system 10 is configured to pull a continuous stream from the supply station 104 and into a converting station 102, where the converting station 102 converts the high-density material into a low-density dunnage material. The line of material 19 can be converted by crumpling, folding, flattening, creasing, or other similar methods that converts high-density configuration to a low-density configuration. Further, it is appreciated that various structures of the converting station 102 can be used, such as those converting stations 102 disclosed in U.S. Publication 2012/0165172, U.S. Publication No. 2011/0052875, and U.S. Pat. No. 8,016,735. In one embodiment, the system 10 is particularly adapted for pulling the line of material 19 from a center of a roll of sheet material creating a coiled stream of material entering the system 10, which is further described below. The roll of sheet material can include a line of sheet material 19 wound upon itself to form the roll that is later converted into dunnage. Multiple rolls can be daisy-chained together.

Referring to FIG. 1, an embodiment of a line processing system 10 includes dispensing member 74 that dispenses a the line of material 19 along a path in a downstream direction, a supply station 104, and a tear-assist apparatus 76 for assisting a user in severing the line of material 19. The dispensing member 74 can include a converting station 102 that converts the supply material into dunnage. The line of material 19 is dispensed from the supply station 104 and fed into the supply side 60 of the converting station 102 through an infeed member 78. The line of material 19 is then converted by the converting station 102, and then dispensed in along a material path in a dispensing direction out of a dispensing member on the outfeed side 61 of the converting station 102.

Figure 2:
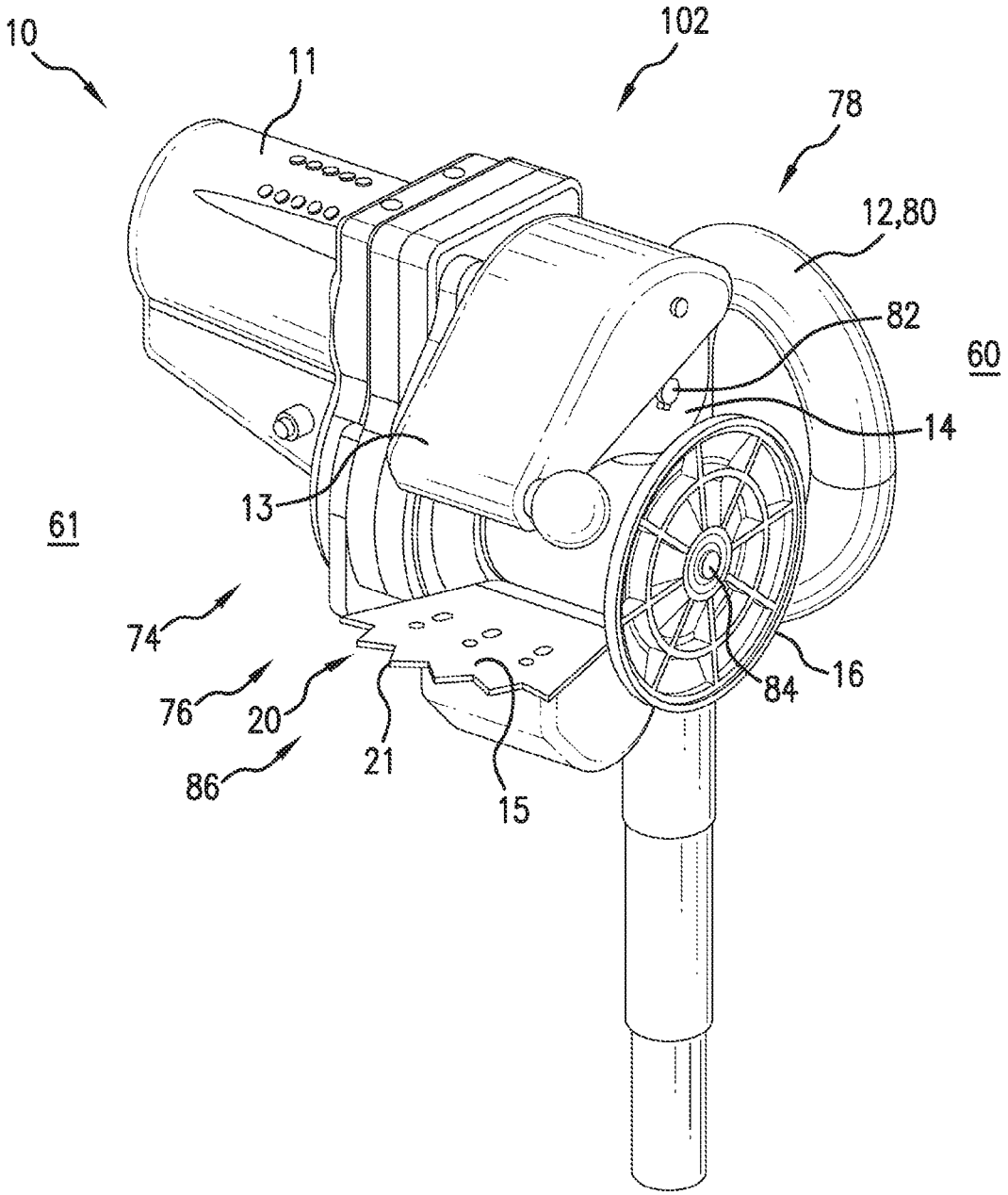
FIG. 2 is a front perspective view thereof showing the converting station and tear-assist apparatus.

In one configuration, the infeed member 78 can include an optional inlet guide 12 for guiding the sheet material into the system 10. In the embodiment of FIG. 2, the inlet guide 12 is a single rolled or bent elongated element forming from the support pole or post 59. The elongated element 80 can be bent around that central axis such that the longitudinal axis is bent about 250° to about 300°, to form a loop through which the line of material 19 is fed through. Preferably, the elongate element 80 is a tube having a round pipe-like cross-section. Other cross-sections and structures may be provided. In the embodiment shown, the elongate element 80 has an outer diameter of approximately 1½". In other embodiments, the diameter may range from approximately ¾" to approximately 3", or from approximately 1" to approximately 2". Other diameters outside the range provided may also be used. In one configuration, the inlet guide 12 also functions as a support portion for supporting the supply station 104, and the elongate element 80 can extend from a floor base 57 configured to provide stability. Optionally, in some embodiments, the elongate element 80 also can provide stability to the converting station 102.

Preferably, the system 10 also includes an actuator for driving the line of material 19. The actuator, in some embodiments, can be part of or associated with the converting station 102. In the preferred embodiment, the actuator is an electric motor 11 or other motive device. The motor 11 is connected to a power source, such as an outlet via a power cord, and may be arranged and configured for driving the system 10. The system 10 can include a transmission portion for transferring power from the motor 11. Alternatively, a direct drive may be used. The motor 11 may be arranged in a housing and may be secured to a first side of the central housing. In some configurations, the line of material 19 can be driven by manually and without power.

During operation of the preferred embodiment, the dispensing member 74 dispenses the line of material 19 by driving it in a downstream, dispensing direction, depicted as arrows "A" in FIG. 3A, which will be described in more detail below. The driving member can include the actuator, such as a motor 11, and a drum 17. The motor 11 may be an electric motor in which the operation is controlled by a user of the system, for example, by a foot pedal, a switch, a button, or the like, or automatically according to a program. The motor 11 can be connected to the drum 17, shown in FIG. 2, which is caused to rotate by the motor 11. The drum 17, in the preferred embodiment, can have a substantially cylindrical configuration. During the process of converting the material 19, the line of material 19 is fed from the supply side 60 of the converting station 102 into the infeed member 78 and over the drum 17 rotating in a converting direction (depicted as "C"), thereby causing the line of material 19 to be driven in the dispensing direction "A" when the motor 11 is in operation.

Figure 3A:
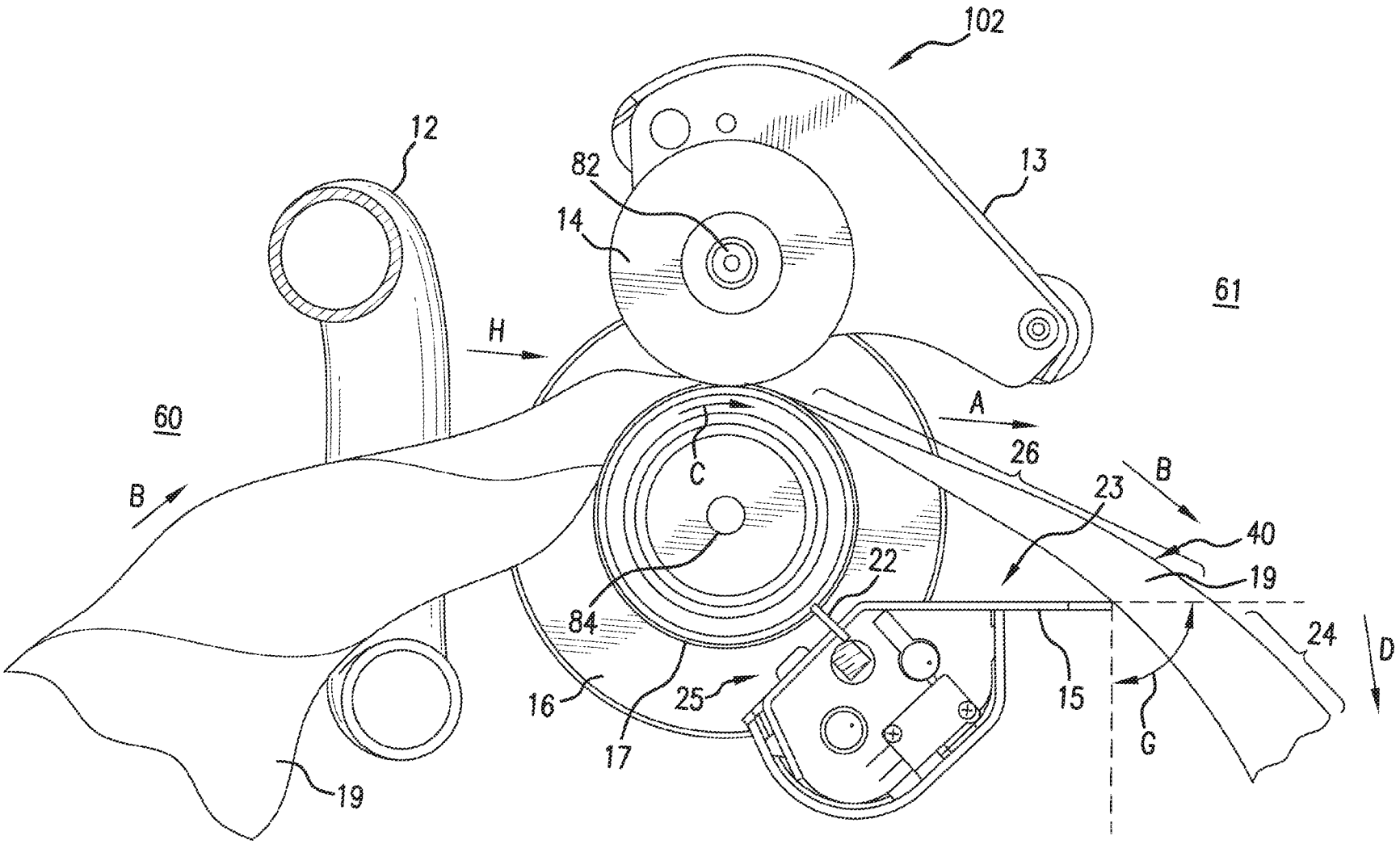
FIG. 3A is a left-side view of the apparatus of FIG. 2.
Figure 3B:
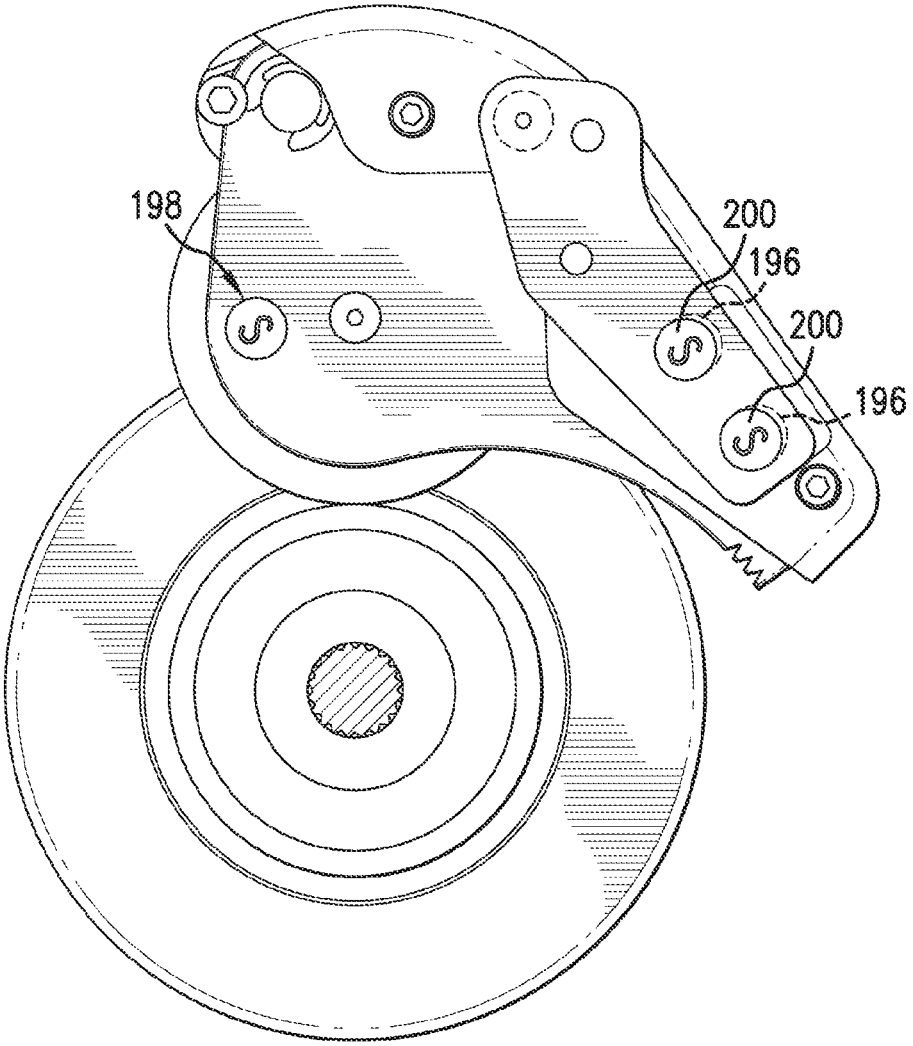
FIG. 3B is a left-side cross-sectional view of the converting station thereof.

As shown in FIGS. 2, 3A, and 3B, the converting station 102 includes a pressing portion 13 that can also include a pressing member. In the embodiment shown, the pressing member comprise of rollers 14. The rollers 14 may be supported via a bearing or other low friction device positioned on an axis shaft 82 arranged along the axis of the rollers 14. Alternatively, the rollers can be powered and driven. The rollers 14 may have a circumferential pressing surface arranged in tangential contact with the surface of the drum 17. That is, for example, the distance between the drive shaft or rotational axis 84 of the drum 17 and the axis shaft 82 of the rollers 14 can be substantially equal to the sum of the radii of the drum 17 and the rollers 14. The rollers 14 may be relatively wide such as about ¼ to ½ the width of the drum 17 and may have a diameter similar to the diameter of the drum 17, for example.

Preferably, the roller 14 has an approximately 2 inch diameter and an approximately 2 inch width. Preferably, the drum 17 has an about 4 to 5 inch diameter. In other configurations, the drum 17 can have a diameter that is up to about 10 to 12 inches, and other embodiments, the drum 17 can have a diameter that is more or less than 10 to 12 inches. Preferably, the drum 17 has a width that is about 4 inches. In other configurations, the drum 17 can have a width that is up to about 10 to 12 inches, and other embodiments the drum 17 can have a width that is more or less than 10 to 12 inches. Other diameters of the rollers may also be provided. The roller diameter may be sufficiently large to control the incoming line of material 19 stream. That is, for example, when the high speed incoming line of material 19 stream diverges from the dispensing direction "A", portions of the line of material 19 can contact an exposed surface of the rollers 14, which can pull the diverging portion down onto the drum 17 and help crush and crease the resulting bunching material. In the preferred embodiment, the motor 11 is connected to a cylindrical driving drum 17, which is caused to rotate by the motor 11. This embodiment can also include one or more drum guides 16 arranged on axial ends thereof in a lateral position relative to the feed direction "H". The drum guides 16 may help to guide the line of material 19 toward the center of the drum 17. The drum guide 16 may be operably connected to the drum 17 to rotate freely with or without the drum 17. As such, the drum guide 16 may be supported off of the drive shaft 84 of the drum 17 via a bearing or other isolating element for allowing the drum guide 16 to rotate relative to the drum 17. In addition, the drum guide 16 may be isolated from the axial side of the drum 17 by an additional space, bearing, or other isolation element for minimizing the transfer of rotational motion from the drum 17 to the guide 16. In other embodiments, the outer drum guide 16 may be supported via a bearing off of the outer axial side of the drum 17 rather than off of the drive shaft 82, for example. While a drum 17 connected with motor 11 is disclosed in this embodiment as part of the dispensing member 84 for driving the line of material 19 in the dispensing direction "A", it will be appreciated that driving mechanisms and means of powering them are possible.

Referring to FIG. 3B, pressing member has an engaged position biased against the drum 17 for engaging and crushing the sheet material 19 passing therebetween against the drum 17 to convert the sheet material into dunnage. The pressing member can optionally have a released position displaced from the drum 17 to release jams. The converting station 102 can have a magnetic position control system configured for magnetically holding the pressing member in each of the engaged and released positions. The position control system can be configured for exerting a greater magnetic force for retaining the pressing member in the engaged position than for retaining the pressing member in the released position. Other systems can use springs, for example, to release jams.

In the example shown, the pressing portion 13, which can include a pressing member such as rollers 14, can be disposed about a pivot axis such that, ignoring gravitational force, the pressing portion 13 is substantially free to pivot in a direction tending to separating the rollers 14 from the drum 17 about the pivot point. To resist this substantially free rotation, the rollers 14 can be secured in position by a position control system configured to maintain the rollers 14 in tangential contact with the drum 17, unless or until a sufficient separation force is applied, and hold the rollers 14 in a released position, once released. As such, when the material 19 passes between the drum 17 and the roller 14, the position control system can resist separation between the pressing portion 13 and the drum 17 thereby pressing the stream of sheet material and converting it into a low-density dunnage. When the rollers 14 are released due to a jam or other release causing force, the position control system can hold the rollers 14 in a released position allowing the jam to be cleared and preventing damage to the machine, jammed material, or human extremities, for example.

The position control system can include one or more biasing elements arranged and configured to maintain the position of the pressing portion 13 unless or until a separation force is applied. In the exemplary embodiment, the one or more biasing element can include a magnetic biasing element 196, as disclosed in U.S. Publication 2012/0165172. The magnetic biasing element 196, shown in FIG. 3B, is positioned behind magnets 200 disposed on the central housing. The magnetic biasing element 196 resists separation forces applied to the pressing portion 113. Additionally, the position control system can also include a release hold element 198, as shown in FIG. 3B, configured to hold the pressing portion 13 in the released open condition once the separation force has been applied and the pressing portion 13 has been released. In the exemplary embodiment, the released hold element can also be a magnetic holding element 198. It is noted that the nature of the magnets can provide the hold down force to require the minimum release force, that is the force applied to overcome the magnetic force of the biasing element, in a manner such that the hold-down force diminishes as the pressing portion 13 is separated from the drum 17. As such, the biasing force of the magnets can be substantially removed when the pressing portion 13 is pivoted to its released position. Some embodiments employ springs or other mechanisms instead of the magnets.

Once the pressing portion 13 is released, the magnets in the release hold element can function to hold the pressing portion 13 in the released condition. In one configuration, the force it takes to release the pressing portion 13 can be greater than the force required to place the pressing portion 13 back into an engaged position. This releasing mechanism can be advantageous to situations in which the user incorrectly positions the sticker on the supply unit, for example, and the supply units and sticker causes the converting station 102 to jam. In such situation, once the release force is reached due to the jam, the pressing portion 13 can release to a release position allowing for the user to easily remove the jam and preventing damage to the converting station 102. While in the embodiment shown, the pressing member are rollers 14, it is appreciated that the pressing member can be a single roller, belt, fixed slide, or other suitable element that biases the material 19 against the drum 17.

The system can further include a tear-assist apparatus 76 to facilitate cutting the line of material 19. The tear-assist apparatus 76 can include a tear-assist unit 86 operable for driving the line of material 19 against the cutting edge 20. In the preferred embodiment, the tear-assist unit 86 pulls the line of material 19 against the cutting member 15, preferably from a distal side of the cutting edge 20 opposite from where a user would pull against the free end of the line of material 19, when activated. Preferably, the tear-assist unit 86 pulls the line of material upstream in a direction opposite the dispensing direction "A" and back towards the converting station 102 and supply side 60, i.e. in the reverse direction. In the embodiment shown, tear-assist unit 86 includes the drum 17. It is appreciated, however, that in other embodiments, the tear-assist unit 86 can include a separate drum or mechanism for driving the line of material 19 in reverse. As shown in FIG. 3A, the line of material 19 in this embodiment is directed to follow along a material path "B", downstream in the dispensing direction "A". The material path "B" is the path in which the line of material 19 follows as it is fed into the converting station 102 from the supply side 60 at the infeed member 78 and dispenses out of the dispensing member 76 on the outfeed side 61 of the converting station 102. The dispensing direction "A" is the direction in which the line of material 19 is dispensed out of and away from the dispensing member 74. The dispensing direction "A", in some embodiments, can be the direction substantially tangent to the drum 17.

To initiate the tear-assist apparatus of the embodiment shown, a user pulls on the line of material 19 in a pulling direction (depicted as direction "D" in FIG. 3A) causing the tear-assist unit 86 to move the line of material 19 in reverse. The pulling direction "D" can be a direction away from the converting station 102, or in the embodiment shown, preferably, a direction that is typically away from the converting station 102 and generally downward with respect to the blade 15. If the blade is oriented sideways or above or below the converting station 102, the pulling direction "D" can be oriented differently, such as horizontally.

The tear-assist apparatus can include a cutting member to facilitate cutting the line of material 19. In the embodiment shown, cutting member includes a blade 15 and the pulling of the line of material 19 against the blade 15 cuts the line of material 19. The blade 15 is disposed on a single lateral side of or downstream of the material path "B". Preferably, the blade 15 is disposed adjacent and below the drum 17, and substantially downstream along the material path "B". It is appreciated that in other configurations, the blade 15 can be arranged in other suitable positions with respect to the converting station 102. Preferably, the tear-assist apparatus include a single cutting member or blade 15 that relies on the user holding the material against the blade to cut the material 19 and not a second mechanical member.

The cutting member can include a forward portion 23, and a back portion 25. In the embodiment shown, the back portion 25 and forward portion 23 are angled with respect of each other. The back portion 25 includes a finger guard 22 (further described below) to prevent the line of material 19, user appendages, and other debris from falling back behind the drum 17. In other configurations, the forward portion 23 and back portion 25 can extend along the same plane. For example, extend along the dispensing direction "A" or curved along the material path "B" downstream the dispensing direction "A". It is appreciated, however, that in some configurations the cutting member does not include the back portion 25.

The forward portion 23 in the embodiment shown comprises the blade 15. The blade 15 has a blade flat 26 that extends from the cutting edge 20 to the back portion 25. A blade flat 26 is a term of art known to mean the portion of an extensive surface leading back from the cutting edge. Preferably, the blade flat 26 is generally flat and extends generally downstream along the blade 15 and terminates on at the cutting edge 20. It is appreciated, however, that in other configurations the blade flat 26 can have an arcuate shape, bowed, or curved. The blade flat 26 can act as a guide for the dispensing line of material 19 such that it guides or deflects the line of material 19 away from the converting station 102 in the dispensing direction "A".

The blade 15 can include a cutting portion, such as a cutting edge 20, at the leading end thereof, which is oriented away from the converting station 102. The cutting edge 20 can be disposed at the leading end of the blade 15 and downstream the dispensing direction "A". The cutting edge 20 is preferably configured to sufficiently engage the line of material 19 when the line of material 19 is pulled against the cutting edge 20 or drawn in reverse, as described below.

Preferably, the blade 15 extends downstream from the converting station 102 in the dispensing direction "A".

Preferably, the blade 15 is positioned such that it extends along a plane substantially tangent the drum 17. In the embodiment shown, the blade 15 extends generally in the dispensing direction "A" along a horizontal plane. It is appreciated that in other embodiments, other positions of the blade 15 can also be used, for example, the blade 15 can be positioned such that the cutting edge 20 extends generally perpendicular to the dispensing direction "A" such that the line of material 19 passes over the cutting edge 20 and the cutting edge 20 guides the line of material 19 as it is dispensed.

Figure 4A:
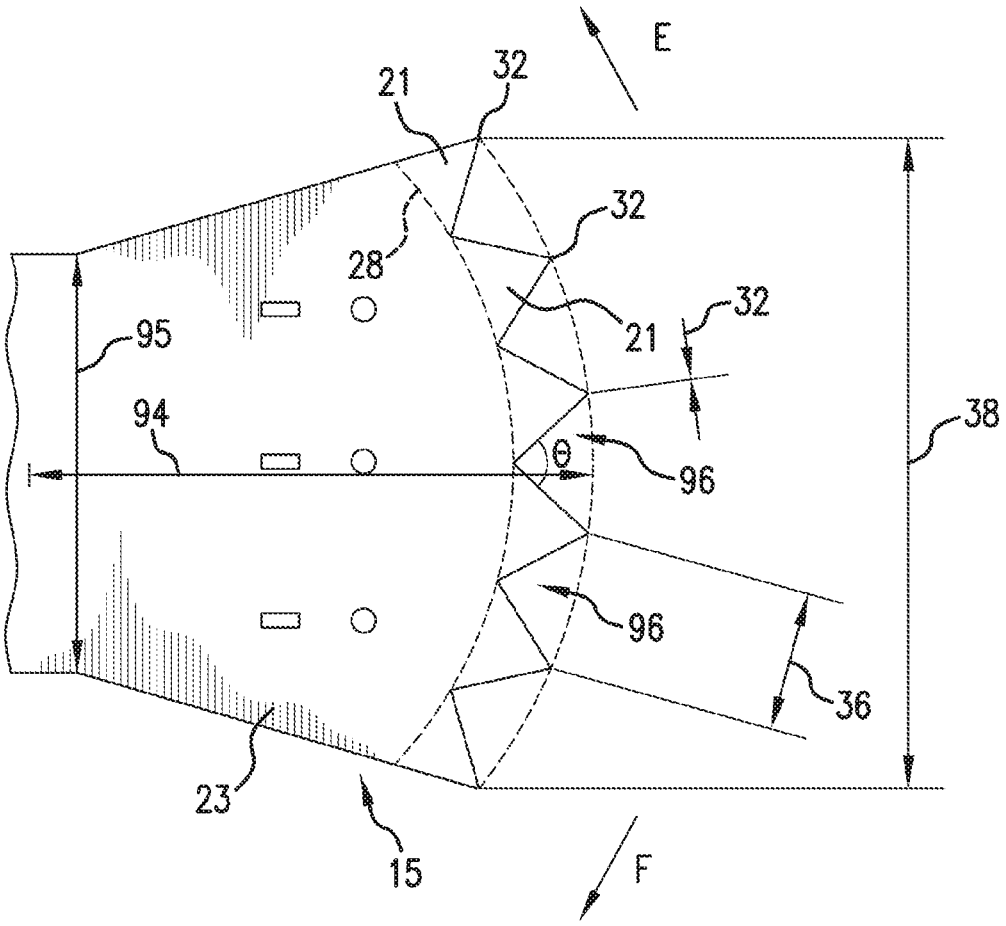
FIG. 4A is a top view of the tear-assist cutting member of the apparatus of FIG. 2.

As shown in FIG. 4A, the cutting edge 20 can have a generally arcuate shape, such as a convex shape or arc, along a phantom line 28 that curves and extends downstream in the dispensing direction "A". The arcuate shape can have a radius 94 that is preferably about at least 25 mm, more preferably about at least 50 mm, and most preferably at least 70 mm. The arcuate shape can have a radius 94 that is preferably up to about at least 500 mm, more preferably up to about 200 mm, and most preferably up to about 150 mm. In the preferred embodiment, the arcuate shape has a radius of 100 mm. In other configurations, the cutting edge 20 can have an elliptical or non-constant radius.

Alternatively, in some configurations, the cutting edge 20 can comprise of a series of straight segments that together form a generally arcuate or convex shape. Each segment can include several cutting elements arranged in a straight line, or can be continuous, curved arc, or can include other arrangements that collectively define the convex arc so to reduce the number of cutting elements that initially engage and/or cut the material at any particular time as the material is pulled against the blade 15. In yet other configurations, the cutting edge 20 can have other configurations, for example, the cutting edge 20 can be a straight, blunt or sharp edge in which the straight edge is transverse the dispensing direction "A". Alternatively, the cutting edge 20 can have an arcuate shape in which the cutting edge 20 arcs upward toward the line of material 19 such that it (and optionally the blade flat) forms a U-shape and the top portion of the U-shape extends upward toward the line of material 19, or in other configurations, the legs of the U-shape can extend toward the line of material 19 with the U-portion extending downward.

The cutting edge 20 can include contact elements, such as cutting elements, which are configured to engage the line of material 19 to facilitate initiating a tear or partially or fully tearing through the material 19. The cutting elements can be spaced along the cutting edge 20 sufficiently such that when the line of material 19 is being pulled in reverse or when the user is pulling the line of material 19 against the cutting edge 20, the cutting elements catch on the line of material 19. The cutting elements catching on the line of material 19 creates resistance or force against the reverse direction and cuts the line of material 19.

Figure 4B:
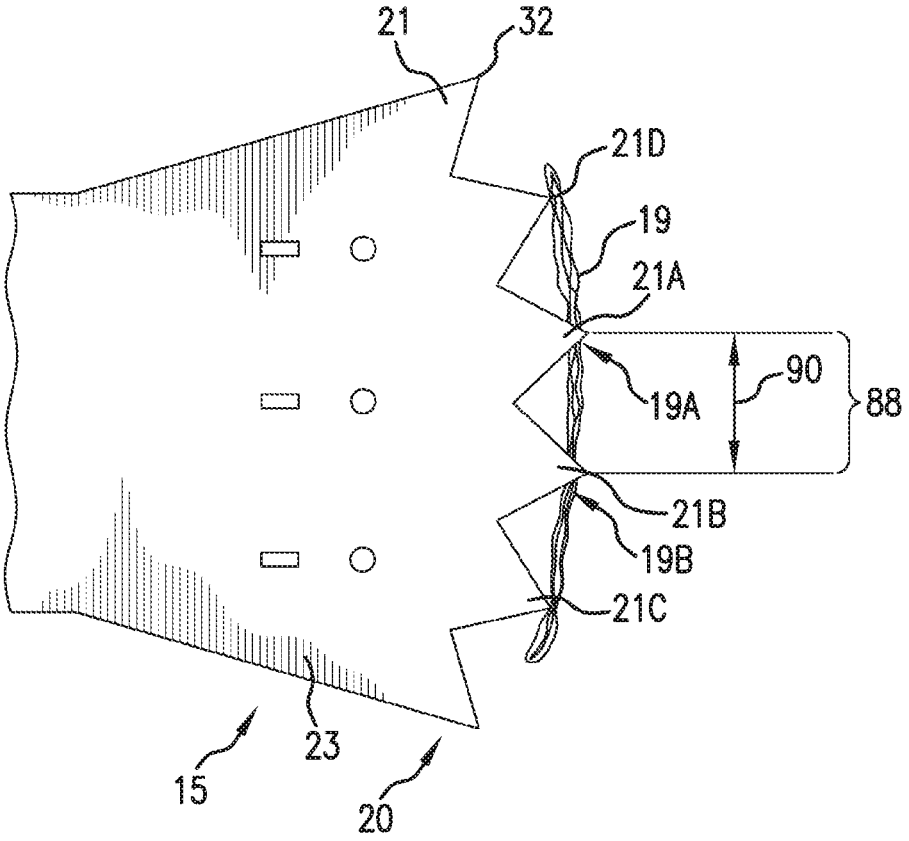
FIG. 4B is a top view thereof initiating a cut through a line of material.

As shown in FIGS. 4A and 4B, the cutting elements can be spaced along the phantom line 28. Preferably, the cutting elements are spaced from each other so that when a user grips and pulls the line of material 19 against the blade 15, the line of material 19 initially contacts an initial group of the number of cutting elements that face the material 19, and contacts additional ones of the cutting elements once the initial group has initiated cutting the material. In the preferred embodiment, the cutting elements are teeth 21, such as serrations, that are aligned along the convex arc of the cutting edge 20 such that the tip 32 of the teeth 21 extend downstream from the cutting edge 20 and together also form a convex shape. By having the teeth 21 arranged in such fashion, the teeth 21 can engage the line of material 19 at a wider range of lateral points than a traditional straight edge. Thus, the user is not limited to pulling the line of material 19 in a straight downward direction against the cutting edge 20, i.e., a generally 90 degree angle with respect to the cutting edge 20, but instead, can sufficiently engage the teeth 21 when pulling the line of material 19 against the cutting edge 20 in a direction that is generally downward and transverse (depicted as "E" and "F" in FIG. 4A) with respect to the dispensing direction "A". For example, when the user pulls the line of material 19 in a direction that is generally left and downward with respect to the cutting edge 20, the line of material 19 can sufficiently engage or catch the left teeth 21.

Preferably, the teeth 21 include a tip 32 at the leading edge. Preferably, the tip 32 has a blunted edge so that it is less prone to puncturing all the way through the line of material 19 creating large puncture holes. The tip 32 of the teeth 21 can have a transverse width 34 of about 0.05 mm to about 1 or 5 mm or more in some embodiments, and can be blunted or sharp.

The teeth 21 are preferably spaced from each other at a sufficient distance such that when the line of material 19 is pulled in a pulling direction "D" against the cutting edge 20, the pressure of the line of material 19 against the teeth 21 is concentrated on a fraction of the number of teeth 21 along the cutting edge 20 and thereby minimizing tearing forces. For example, the teeth 21 can be spaced from each other at a suitable pitch 36 depending on the material processed through the system, with pitch 36 typically being of about at least 5 mm, and more typically at least 1 cm or 2 cm, up to typically about 6 cm, and more typically up to about 5 cm or 4 cm. In one embodiment the teeth pitch 36 is around 3 cm with the width 38 being about 15 cm. In the preferred embodiment, as shown in FIG. 4A, the teeth 21 have a substantially triangular shape such that the sides of the teeth converge together to form the tip 32. In this embodiment, gullet 96 between each of the teeth 21 can have an angle θ shown in FIG. 4A. Preferably, gullet 96 between each of the teeth 21 has an angle such that the line of material 19 quickly fractures laterally and completely when the tear-assist unit 86 moves the line of material 19 in reverse. It is appreciated, however, that in other embodiments, the tear-assist unit 86 partially cuts the line of material 19 to facilitate tearing. The angle θ can be at least about 30° up to about 110°, more preferably at least about 45° to up to about 135°, and most preferably the angle θ is around a right angle. It is appreciated that the teeth 21 can have other suitable shapes, for example, the teeth 21 can have a rectangular, trapezoidal, or rounded shape that extends from the cutting edge 21, or can have other suitable geometric shapes.

The cutting member can also include a finger guard 22, as shown in FIG. 3A, which protects users from getting caught between the converting station 102 and cutting member. The finger guard 22 can also be used to prevent stray pieces of line material 19 from falling between the cutting member and converting station 102, which could cause jamming of the converting station 102. The finger guard 22 is preferably disposed on the back portion 25 of the cutting member.

In operation, the user feeds a desired length of the line 19 at the supply side 60 of the converting station 102 which is then moved in a dispensing direction "A" by the operation of the motor 11 and dispensed at the outfeed side 61, such as out the dispensing member. The drum 17 turns in coordination therewith, and the line 19 is fed out of the machine along a material path "B". The material path "B" can be broken up into separate segments: feed path, outfeed path, and severable path. In the embodiment shown in FIG. 3A, the material path "B" can be bent over the cutting edge 20. The line of material 19 on the outfeed side 61 of the converting station 102 can be broken into two portions at the point in which the material path "B" is bent or the cutting edge 20: an outfeed portion 26 that is disposed between the drum 17 and blade 15 and a severable portion 24 that is disposed beyond the blade 15. The line of material 19 can further include a cutting location 40 that is disposed between the outfeed portion 26 and severable portion 24, and at above the cutting edge 20.

The drum 17 continues dispensing the line of material 19 until a desired length has been reached. At this point, the operator or user stops the motor 11, and the dispensing movement of the line 19 stops. The user then pulls the line of material 19 at the severable portion 24 in a pulling direction "D". As discussed above, because of the convex or arc shape of the blade 15, the line of material 19 can sufficiently engage the blade 15, such as at the teeth 21, when pulled in a downward direction that is generally transverse and angled with respect to the dispensing direction "A", for example, to the left or right of the dispensing direction "A".

Upon pulling the line of material 19 by the user, the tear-assist unit causes the drum 17 to drive the line of material 19 in a reverse direction. In one embodiment, as the drum 17 rotates in reverse, a portion of the converted line of material 19 can be reversed back under the pressing members.

In the preferred embodiment, the cutting edge 20 has a transverse width 38 that extends across the material path "A" (as shown in FIG. 4A) and the transverse width 38 of the cutting edge 20 is greater than the transverse width of the line of material 19 at the cutting location 40. As the user pulls on the line of material 19, there is more pressure against the proximate most teeth 21A,21B at a contact area 88 than the teeth 21C,21D that are disposed most distally from the pulled material. The higher localized pressure on the proximate most teeth initiates the severing process, initiating and creating initial cuts 19A,19B in the line of material 19 and additional subsequent cuts 19C,19D can be made at the distal teeth 21C,21D as the line of material 19 is pulled against the blade 15. The proximate most teeth 21A,21B initiates the first cuts 19A,19B so that additional subsequent cuts 19C,19D can be made progressively or sequentially thereafter, and thereby minimizes the tearing forces required to cut the line of material 19. The convex shape of the blade 15 allows for a decrease in overall tearing forces because the cuts are made progressively or sequentially instead of all at once. In the embodiment shown in FIG. 4B, the contact area 88 includes two teeth 21A,21B of the cutting edge 20. It is appreciated that the location and transverse width 90 of the contact area 88 can vary in some embodiments depending on dimensions of the line of material 19 and the number of contact elements within the contact area 88 can vary depending on the number of teeth 21 on the blade 15. As used in this context, the initiation of cuts can include partial or fully piercing, ripping, slicing, tearing, piercing, breaking, or otherwise severing material 19 at a desired location or point.

The initial contact area 88 is a portion of the entire cutting edge 20, and has a transverse width 90 that is less than the transverse width 38 of the cutting edge 20. The contact area 88 has a transverse width 90 that is preferably up to about ¾ the transverse width 38, more preferably up to about ½ the transverse width 38, and most preferably, up to about ⅓ the transverse width 38. The contact area 88 has a transverse width that is preferably at least about ⅛ the transverse width 38, more preferably about at least ¼ the transverse width 38, most preferably about at least ⅓ the transverse width 38.

The transverse width 38 is preferably at least about the width of the line of material 19 being dispensed from the dispensing member 74. In some embodiments, the transverse width 38 is about at least 2 inches to about at most 20 inches, or about at least 3 inches to about at most 10 inches. In some embodiments, the transverse width 38 is about 5 inches. Preferably, as shown in FIG. 3A, the transverse width 95 of the forward portion 23 is up to about the width of the drum 17. In the embodiment shown, the width 95 of the forward portion 23 gradually increases toward the cutting edge 20 such that the transverse width 38 of the cutting edge 20 is greater than the transverse width of the forward portion 23 closest to the drum 17. As a result, the sides of the forward portion 23 can flare in an outward lateral direction with respect to the dispensing direction "A". In other embodiments, the blade 15 can have a width that is less than the width of the drum 17 or greater than the width of the drum 17.

In one embodiment, a line processing unit includes and functions as all of the tear-assist unit 86, the dispensing member 84, and the converting station 102 and also includes a drum and pressing portion. In such embodiment, for example, the tear-assist unit 86, the dispensing member 84, and the converting station 102 all include the drum 17. As such, the tear assist unit 86 can include all or part of the dispensing member 84 and/or the converting station 102. In alternative embodiments, however, one or more of these systems can include separate elements that manipulate the material. In the present embodiment, drum 17 drives the line of material 19 in the dispensing member 84 in both the dispensing direction and reverse direction. In one embodiment, the reverse movement is by a power source other than the motor 11.

In some embodiments, the reverse rotation is a pulse of the drum 17 initiated by the tear-assist unit 86 can be about less than a millisecond in duration, or about less than 10 milliseconds in duration, or about less than 100 seconds in duration, although other types of movement can be used. In some embodiments, the line 19 may be pulled along the material path "B" opposite the dispensing direction "A" toward the supply side 60 of the converting station 102 by at least about 0.25 inches, 0.5 inches, 1 inch, 2 inches, or 5 inches, or more during the cutting operation. In the preferred embodiment, the line 19 is pulled into the opposite direction toward the supply side at a sufficient distance, preferably about ½ inch to an inch, such that the converted line of material 19 is not pulled so far toward the supply side 60 that it disengages with the converting station 102, and thus requiring the material 19 to be reloaded onto the converting station 102.

In the preferred embodiment, the reverse movement of the line of material 19 and the pull of the line 19 in the pulling direction "D" cooperatively cuts the line of material 19. Preferably, the cutting edge 20 sufficiently catches the line of material 19, for example caused at the cutting elements, such that the force of the reverse movement and the resistance caused by the cutting edge 20 causes the line of material 19 to cut. For example, preferably, the teeth 21 at the cutting edge 20 catches or engages the line of material 19 by partially piercing through the material 19 at the tip 32 of the teeth. In one embodiment, the reverse movement pulls a slight distance such that the line 19 creates a weakened area or a partial tear.

As illustrated in FIG. 3A, the angle "I" between the line of material 19 dispensing from the dispensing member 74 generally tangential to the drum 17 and the cutting edge 20 is about at least 10° to up to at most 40°. Preferably, the angle "I" is about 30°. The angle "G" at which the user holds the line of material 19 facilitates the engagement of the blade 15 with the line of material 19. Angle "G" is defined as the angle between the dispensing direction "A" of line of material 19 at the cutting edge 20 and the position the severable portion 24 being held by the user. The severable portion 24 can also be, in some embodiments, the end portion of the line of material 19. Preferably, the angle "G" at which the user pulls the severable portion 24 of the material 19 is about 15°, more preferably angle "G" is about 75°, and most preferably the angle "G" is at most about 130°.

In other embodiments of the cutting member, the member can be a bar or a wire that sufficiently engages the line of material 19 such that both the force of the user pulling in one direction and the force of the tear-assist unit 86 pulling the line of material 19 in a reverse direction cooperatively partially or fully tears the line of material 19.

The tear-assist apparatus 76 can further comprise a sensing unit 42 that senses the movement of the line of material 19 as it is pulled in the pulling direction "D" or, in some configurations, a downward direction. The sensing unit 42 is associated with the tear-assist unit 86 such that when the line of material 19 is pulled in the pulling direction "D" or downward direction, the sensing unit 42 activates or triggers the tear-assist unit 86.

Figure 5A:
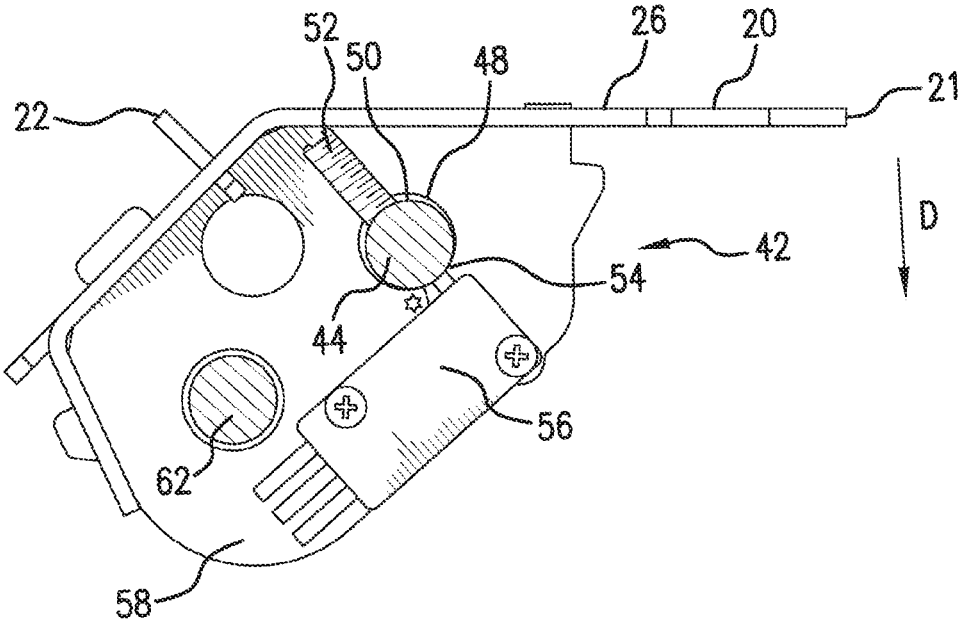
FIG. 5A is a left-side view of an embodiment of the tear-assist apparatus in a rest position.
Figure 5B:
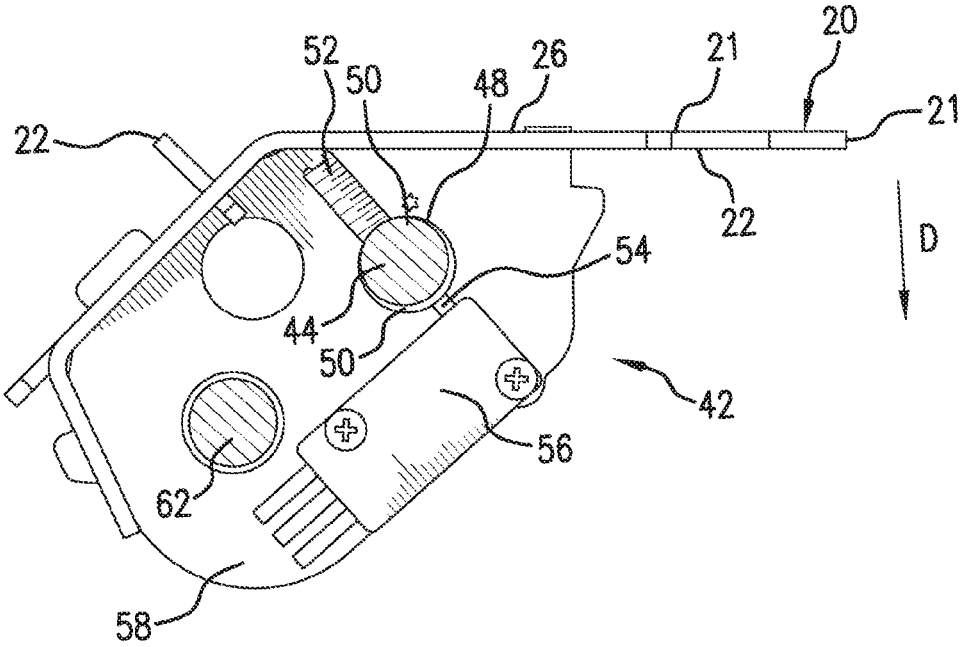
FIG. 5B is a left-side view thereof in an activated position.

FIGS. 5A and 5B illustrate another embodiment of the sensing unit 42. The blade 15 is preferably attached to a mounting plate 58. Preferably the blade 15 is moveable about a forward shaft member 44 and pivotable about a pivoting shaft member 62 such that the force of the line of material 19 being pulled in direction "D", which in this case is a downward direction, causes the blade 15 to pivot about the pivoting shaft member 62, such as in a downward direction or generally in direction "D". The sensing unit 42 further comprises a switch 56, such as a micro switch, but other types of sensors can also be used. The switch 56 can be affixed to the mounting plate 58 such that as the blade 15 is moved, the mounting plate 58 and switch 58 also move with the blade 15, although the switch can instead be mounted to a stationary portion of the device to detect movement of the blade 15. As illustrated in FIGS. 5A and 5B, the shaft opening 48 of the forward shaft member 44 is larger than the forward shaft member 44 such that there is a gap 50 that permits and angularly limits pivoting about shaft 62.

FIG. 5A illustrates the blade 15 and sending unit 42 of the tear-assist apparatus 76 at a rest position which is the position in which the converting station 102 is dispensing material 19 or the line of material 19 is not being pulled in the trigger direction "D". The sensing unit 42 further includes a spring 52 which is compressed against on the shaft 42, pushing the blade flat 26. Alternative embodiments can use other types of springs and spring arrangements, such as springs in compression or tension, or use gravity to normally return to the untriggered position of FIG. 5A. The spring 52 causes the shaft member 44 to press against the switch plunger 54 during the rest position. The switch plunger 54 is associated with the switch 56. When the switch plunger 54 is depressed by the shaft member 44, the tear-assist unit is not triggered or activated. Preferably in the rest position, the gap 50 is above the shaft member 44 because the spring 52 is pushing the blade 15 away from the direction of the shaft member 44.

Upon the user pulling on the line of material 19 in a trigger direction "D", the blade 15 pivots about the pivoting shaft member 60 moving the blade 15 and mounting plate 56 in a generally downward direction. Preferably the forward shaft member 44 remains fixed such that as the mounting plate 56 and blade 15 move downward, the forward shaft member 44 is released from the switch plunger 54 because the movement of the mounting plate 56 closes the gap 50, which is initially above the forward shaft member 44 in the rest position. FIG. 5B illustrates the triggering of the tear-assist apparatus in which the switch plunger 54 is released. The release of the switch plunger 54 triggers the switch 56 to cause the converting station 102, for example, in some configurations the drive unit, to move the line of material 19 in a reverse direction.

In some embodiments, the force required to displace the blade 15 is about at least ½ lb., about at least 1 lb., or about at least 2 lbs. In some embodiments, the force is about at most about 10 lbs., and more preferably the triggering force is about at most about 5 lbs, at most about 4 lbs, or at most about 2 lbs. Other triggering forces can be selected.

Figure 6:
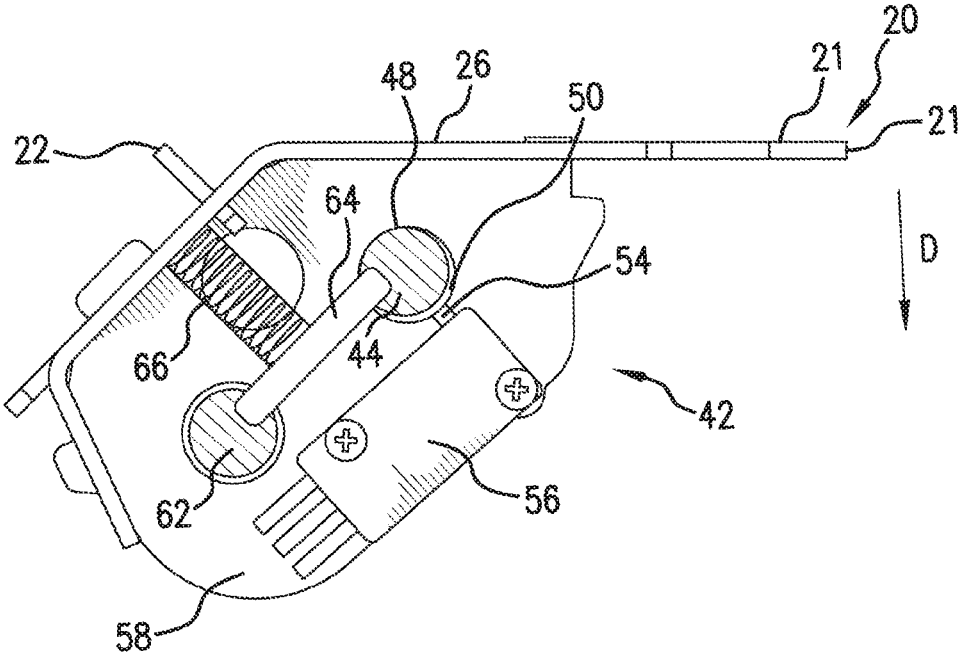
FIG. 6 is a left-side view of another embodiment of the tear-assist apparatus in an activated position.

FIG. 6 illustrates another embodiment of the sensing unit 42 in the triggering position in which the switch plunger 54 is released. The sensing unit 42 of this figure includes a bar 64 that connects the forward shaft member 44 and the pivoting shaft member 62. The sensing unit 42 further includes a spring 66 that presses against the bar 64 to push the blade 15 away from the bar 64. Similar to the sensing unit 42 described above, the forward shaft member 44 is fixed while the blade 15 and mounting plate 58 move in response to the user pulling on the line of material 19 in the pulling direction "D". Upon pulling on the line of material 19 in a trigger direction "D" or downward direction, the mounting plate 56 and blade 15 move downward closing the gap 50, which is initially above the forward shaft member 44 in the rest position, and releasing the forward shaft member 44 from the switch plunger 54. It is appreciated that other suitable arrangements of the spring, shaft members, and switch can be used.

In alternative embodiments, the sensing unit is configured to detect parameters indicative of the user pulling the severable portion 24 of the dunnage out from the device and against the cutting member. For example, in one embodiment, the sensor is configured to detect the displacement other than in rotation, of the cutting member with respect to the converting station. Upon detecting the minimum displacement of the cutting member, which reflects that a user is pulling by hand on the material, the motor can be activated causing reverse movement on the line of material 19, or another mechanism can pull the material against the cutting member.

In one embodiment of the sensor, the sensor is configured to detect the current induced in the motor 11 by the dunnage pulling the motor 11 in a forward direction. Upon detecting the minimum current, which is reflective of the minimum speed and/or distance of the dunnage being pulled out of the machine that is commenced of a user pulling by hand, the motor is activated to reverse.

In another alternative embodiment of the sensing unit, the sensing unit is configured to detect parameters reflective of a pulling initiated only by the user, and not from another part of the device or due to residual motion of the converting station 102. Thus, while the converting station 102 is in operation, the motion of the dispensing member 74, dispensing of the line of material 19, or other motions will not cause the sensing unit to trigger the tear assist apparatus.

In one embodiment of the sensing unit, when the appropriate trigger force is applied to the line of material 19, the sensing unit sends a signal to the tear-assist unit 86 to initiate a short rotational movement of the drum 17 in the direction opposite the dispensing direction "A", thereby causing the line 19 to be pulled in a reverse direction. As discussed above, this reverse motion and the pulling by the user cooperatively engages the line of material 19 with the cutter 15 causing the line of material 19 to partially or fully tear or sever. The tear-assist thereby assists the user in tearing the line. In one embodiment, this short reverse impulse causes the line 19 to engage more directly with the cutting edge 20 of the blade 15, and as such assists the user in tearing or severing the line 19. The cutting edge 20 sufficiently catches the line of material 19 such that the reverse pull caused by the drum 17 provides a tear-assist force, and decreases the force required by the user pull in order to sever the line 19.

In another embodiment, the sensing unit detects the pulling motion by the sensing of electric current or voltage in the motor 11 while not in operation. For example, as the user pulls the line 19, the drum 17 is caused to rotate, which in turn causes the motor to rotate. This rotation of the motor 11 induces an electric current therein, which may be detected by the sensing unit. At this point, the sensing unit causes the motor to operate, as discussed above, in the direction opposite the dispensing direction. In an alternate embodiment, pull motion is detected by the sensing unit using mechanical members, for example a switch or button or like member is engaged and caused to be moved when the line 19 is pulled, such movement being detectible by the sensing unit.

Figure 7:
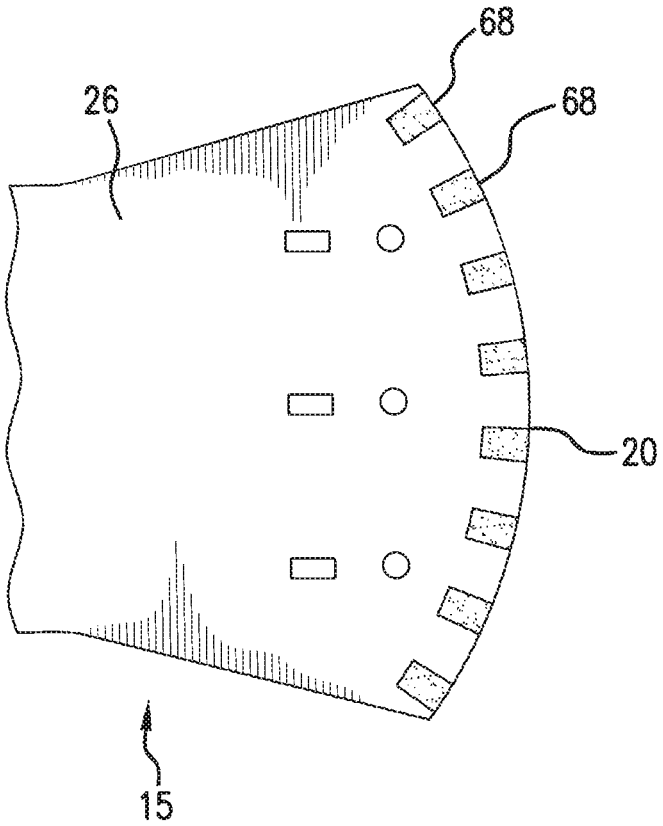
FIG. 7 is a top view of another embodiment of a tear-assist cutting member.

FIG. 7 illustrates an alternative embodiment of the cutting elements. As illustrated in FIG. 7, the cutting elements can be selective surfaces along the cutting edge 20. The selective surfaces can be contact elements 68 having a sticky or high friction surface. The contact elements 68 can be integrated on the blade flat 26 of the blade 15 or can be separate elements 68 affixed to the blade flat 26. The blade 15 can have a cutting edge 20 with a convex or arc shape, and the contact elements 68 can be aligned along the convex or arc shape of the cutting edge 20. The cutting edge 20 can be a sharp edge or blade and, in some configurations, can include teeth and serrations in addition to the contact elements 68. Similar to the cutting elements described above, the contact elements 68 engage the line of material 19 such that when the line of material 19 is being pulled in the reverse direction, the contact elements 68 grip the line of material 19 by frictional force, sticky material, or the like, to cause resistance or force against the reverse the direction. The contact elements 68 and reverse movement cooperatively initiate a tear, or partially or fully tear the line of material 19.

Figure 8:
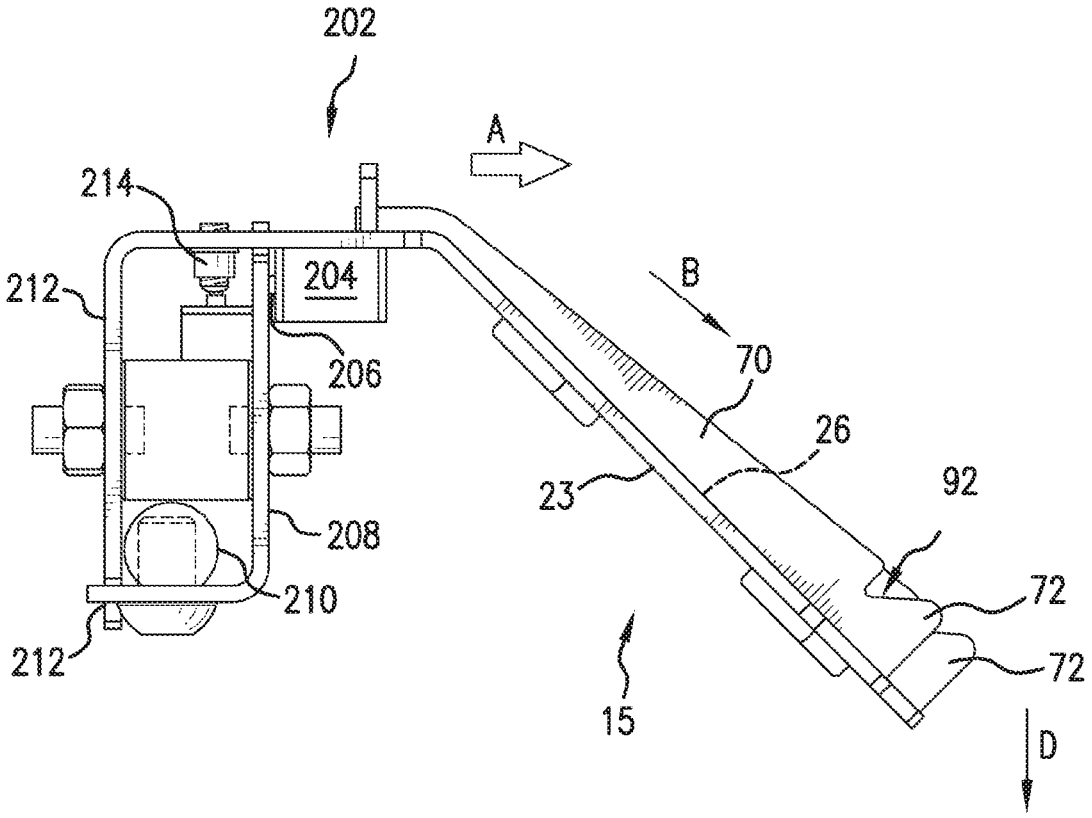
FIG. 8 is a left-side view of another embodiment of a tear-assist apparatus.

FIG. 8 illustrates an alternative embodiment of the tear-assist apparatus. In the embodiment of FIG. 8, the blade 15 slopes downward with respect to the dispensing direction "A". The blade flat 26 of the blade 15 further comprises guide plates 68 that extend upward from the blade flat 26. The guide plates 70 have catching tips 72 that catch or engage the line of material 19 when the user pulls the line of material 19 in a pulling direction "D". The catching tips can be disposed in a straight line or on an arc or other suitable arrangement. In the embodiment shown, the catching tips 72 are primarily used to engage the line of material 19 when pulled in direction "D". The guide plates 70 can also include recesses 92 to facilitate catching or engaging the material 19 when the line of material 19 is pulled in a reverse direction. In some embodiments, the guide plates 68 can include the catching tips 72 without the recesses 92. In the embodiment shown in FIG. 8, the tear-assist apparatus can include a sensing unit 202. The sensing unit 202 includes a switch 204, such as a microswitch, with a plunger 206 adjacent a fixed plate 208. In the rest position (i.e., the position in which the tear-assist apparatus is not activated), the plunger 206 is depressed against the fixed plate 208. In the embodiment shown in FIG. 8, a pivot plate 212 is connected to the blade 15 and the pivot plate 212 is moveable about a pivot point 212 such that the force of the line of material 19 being pulled in a downward direction by the user causes the blade 15 to also move. As the blade 15 moves, the plunger 206 is moved away from the fixed plate 208 which in turns activates the tear-assist unit to drive the line of material 19 in reverse. The fixed plate 208, pivot plate 212, and blade 15 can be mounted on a mounting rod 210. An adjustable stop 214 can also be provided.

As discussed above, in the preferred embodiment, the supply material is a line of material 19, such as preferably a line of sheet material. The sheet material preferably has a basis weight of about at least 20 lbs to about at most 100 lbs. Preferably, the line of material 19 comprises paper stock stored in a high-density configuration having a first longitudinal end and a second longitudinal end, which is later converted into a low-density configuration. In the preferred embodiment, the line of material 19 is a ribbon of sheet material that is stored as coreless rolls, as shown in FIG. 1, where the first longitudinal end is the inner end 12 of the roll, and the second longitudinal end is the outer end 114 of the roll extending therefrom and opposite the outer end 114. The rolls are formed by winding the ribbon of sheet material upon itself to create multiple layers and preferably leave a hollow center. The axial height of the rolls is preferably about at least 5". Typically, the axial height of the roll is about 12" to 48". The outer diameter of the rolls is preferably about at least 5". The diameter 39 of the rolls is preferably about up to 24". The inner diameter of the center of the roll 4 is typically about at least 2" or at least 3". The diameter of the center of the roll is typically about up to 8", more preferably up to about 6" or 4". Other suitable dimensions of the supply rolls can be used. In one example embodiment of the rolls, the outer diameter 39 of the roll is about between 11" to 12¼", and the inner diameter 41 is about 3" to 6". Large or smaller rolls can be used in other embodiments.

The sheet of material may be made of a single ply or multiple plies of material. Where multi-ply material is used, a layer can include multiple plies. It is also appreciated that other types of material can be used, such as pulp-based virgin and recycled papers, newsprint, cellulose and starch compositions, and poly or synthetic material, of suitable thickness, weight, and dimensions.

In one embodiment, as shown in FIG. 1, the rolls comprise a sticker 6 having a connecting member and a base member, which are longitudinally adjacent to each other, as well as a release layer. Preferably, the sticker facilitates daisy chaining the rolls together to form a continuous stream of sheet material that can be fed into the converting station 102. For example, as illustrated in FIG. 1, the inner end of the lower roll is adhered to the outer end of an upper roll stacked directly upon the lower roll. The inner end 12 of the upper roll is fed into the converting station 102. As the upper roll is exhausted, the sticker 6 pulls the inner end 12 of the lower roll into the converting station 102, thereby creating a continuous stream. It is appreciated, however, that the supply material can be arranged in various configurations. For example, more than two rolls could be daisy-chained together, or only one roll could be loaded into the system 10 at a time, or the supply material can be arranged in a fan-folded stack, etc. In other configurations, the daisy chained rolls can be held within a stabilizer 52, as shown in FIG. 1. The exemplary stabilizer 52 shown includes an opening in the front to allow users to, for example, identify the rolls as well as detail loading and operating instructions written, for example, on the sticker 6. In one embodiment of the supply handling unit, multiple stabilizers 52 can be stacked, and the rolls within the stacked stabilizers 52 are daisy-chained together. In one embodiment of the stabilizer 52, the stabilizer 52 maintains the shape of the rolls, and keep the rolls from collapsing when only a few layers are left in each roll, such by gently applying compressive pressure to the outer surface of the rolls.

Preferably, as the material 19 is being fed into the converting station 102 as a coiled stream. It is appreciated, however, that the material may not be oriented as a coil, but in alternative embodiments, could be folded, crumpled, flat without any coil, fold, or crumple, or could have other similar configurations. The preferred width of the material being fed through the converting station 102 is about at least 1", more preferably about at least 2", and most preferably about at least 4". The preferred width 30 of the material being fed through the converting station 102 is about up to 30", and more preferably about up to 10".

Preferably, the line of material 19 being dispensed from the dispensing member 74 has a width that is less than the width of the drum 17. Preferably, the line of material 19 being dispensed from the dispensing member 17 has a width of about 3 inches. In other embodiments, the line of material 19 being dispensed from the dispensing member has a width that is up to about 10 to 12 inches, and in other embodiments, the width can be more or less than 10 to 12 inches. When the user grabs the line of material 19 at the severable portion 24, the width of the line of material 19 at the cutting location 40 is less than the width of the line of material 19 dispensed from the dispensing member 74. Preferably, the of the line of material at the cutting location 40 when the severable portion 24 is grabbed by the user is about 3 inches.

Figure 9:
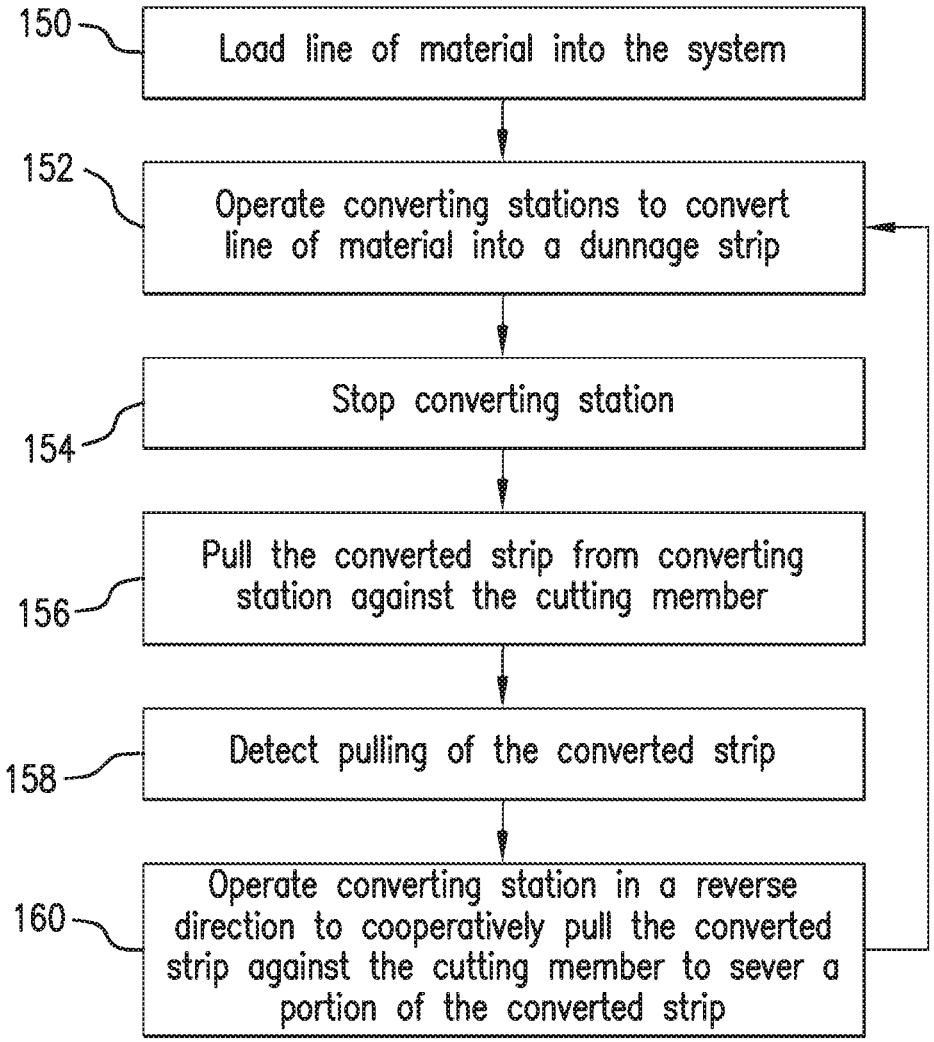
FIG. 9 depicts a flow diagram of operating the processing system.

An illustrative flowchart of a method for operating the tear-assist application is depicted in FIG. 9. In step 150, the line of material 19 is loaded into the system 10. The line of material 19 can be arranged in rolls, a stack of sheet material, or any of the arrangements described above. The material 19 is fed into the converting station 102 through the supply side 60. In step 152, the user operates the converting station 102 to convert the line of material 19 into a dunnage strip. The converting station 102 dispenses the line of material 19 at the outfeed side 61 of the converting station 102 along a dispensing direction or path. The user stops the converting station 102 in step 154. At this point, the severable portion 24 of the line of material 19 is pulled from the converting station and against the blade 15 in a direction outward from the supply side, and preferably in a trigger direction "D" as shown in FIG. 3A and discussed above. The sensing unit detects the pulling of the line of material 19 in step 158. It is appreciated, however, that in some embodiments, it is not necessary to detect the pulling of the line of material 19. In other embodiments, a controller 1000 (shown in FIG. 10) may be configured to control tear-assist apparatus, where input from the sensing unit 31 to the controller 1000 triggers the tear-assist apparatus. The input from the sensing unit 31 to the controller could be a current, or a displacement of the cutting member, or other similar type of inputs. In step 160, the controlling station 102 operates in the reverse direction to cooperatively pull the converted strip against the blade 15 to sever a portion of the converted strip. As discussed above, the converted strip or line of material 19 is pulled in a reversed direction toward the supply side of the converting station 102 while also being pulled in against the blade 15 in a direction outward the supply side of the converting station 102 to cooperatively partially or fully tear the line of material 19.

Figure 10:
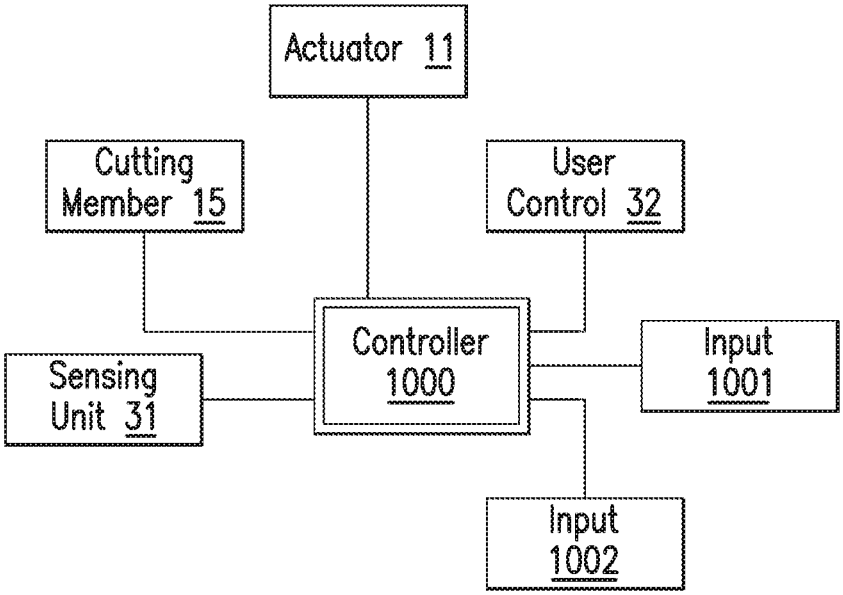
FIG. 10 depicts a system diagram of a tear-assist apparatus.

With respect to any of the embodiments above, as shown in FIG. 10, a controller 1000 may be included and configured to control the tear-assist apparatus. Input to the controller 1000 may be from a sensing unit 31, the actuator 11, user controls 32, the movement of the blade 15, or any other component, represented schematically as one or more inputs 1001, 1002, etc. Controller 1000 may include, but is not limited to, a computer/processor that can include, e.g., one or more microprocessors, and use instructions stored on a computer-accessible medium (e.g., RAM, ROM, hard drive, or other storage device).

The controller 1000 may also include a computer-accessible medium (e.g., as described herein above, a storage device such as a hard disk, floppy disk, memory stick, CD-ROM, RAM, ROM, etc., or a collection thereof) can be provided (e.g., in communication with a processing arrangement). The computer-accessible medium can contain executable instructions thereon. In addition or alternatively, a storage arrangement can be provided separately from the computer-accessible medium, which can provide the instructions to the processing arrangement so as to configure the processing arrangement to execute certain exemplary procedures, processes and methods, as described herein above, for example.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A dunnage apparatus, comprising:

a converting station that converts a line of high-density material into low-density dunnage and dispenses the dunnage along a path in a downstream direction; and a cutting member having a convex cutting edge extending across a majority of the path downstream of the converting station, the cutting edge having teeth with tips that are aligned with each other to thereby define the convex shape of the cutting edge, such that the cutting edge engages and sequentially initiates cuts through the line of dunnage when the line of dunnage is pulled against the cutting member, thereby reducing cutting forces.

2. The dunnage apparatus of claim 1, wherein the cutting member comprises a blade having a blade flat that extends generally downstream along the path and terminating on a downstream side thereof at the teeth.

3. The dunnage apparatus of claim 2, wherein the blade flat has a substantially flat surface.

4. The dunnage apparatus of claim 1, further comprising a tear-assist unit that is operable to pull the line of dunnage against the cutting member to initiate the cuts.

5. The dunnage apparatus of claim 4, wherein the tear-assist unit is operable to pull the line of dunnage upstream with respect to the path against the cutting member to initiate the cuts.

6. The dunnage apparatus of claim 4, further comprising a sensing unit configured to detect a pulling of the line of dunnage by a user in a predetermined direction, wherein the sensing unit is associated with the tear-assist unit such that upon detection of the pulling of the line of dunnage by the user against the cutting member, the sensing unit triggers the tear-assist unit to drive the line of dunnage in a reverse direction along the path against the cutting member to initiate a tear in the line of dunnage.

7. The dunnage apparatus of claim 1, further comprising a drum that is operable for pulling the line of dunnage upstream with respect to the path against the cutting member to initiate cuts.

8. The dunnage apparatus of claim 1, wherein the high-density material is ribbon of paper sheet material.

9. The dunnage apparatus of claim 8, wherein the converting station is configured for longitudinally creasing the high-density material to convert the high-density material into the low-density dunnage.

10. The dunnage apparatus of claim 1, wherein the convex shape is an arc.

11. The dunnage apparatus of claim 1, wherein the teeth are spaced from each other so that when a user grips and pulls the line of dunnage against the cutting member, the line of dunnage initially contacts an initial group of the plurality of teeth that face the dunnage, and contacts additional teeth of the plurality of teeth once the initial group has initiated cutting the dunnage.

12. The dunnage apparatus of claim 1, the cutting edge having top and bottom surfaces that meet at a leading edge, wherein the converting station dispenses the dunnage downstream across the top surface towards the leading edge.

13. The dunnage apparatus of claim 1, wherein the tips of the teeth extend downstream.

14. The dunnage apparatus of claim 1, wherein the convex shape extends across substantially the entire path.

15. The dunnage apparatus of claim 1, further comprising a tear-assist unit, wherein the tear-assist unit and converting station comprise a drum that is operable for pulling the line of dunnage upstream with respect to the path against the cutting member to initiate the cuts.

16. The dunnage apparatus of claim 1, wherein the cutting member is positioned on one side of the line of dunnage without an opposing member.

17. The dunnage apparatus of claim 1, wherein the cutting member is positioned at an exit of the dunnage apparatus such that a user can apply a downward force to the line of dunnage thereby basing the line of dunnage against the cutting member.

18. The dunnage apparatus of claim 1, wherein the cutting member is operable to fully sever the line of dunnage.

19. A dunnage apparatus, comprising:

a converting station that converts a line of high-density material into low-density dunnage and dispenses the dunnage along a path in a downstream direction; and a tear-assist apparatus comprising a cutting member having a cutting edge extending generally downstream with respect to the path and having a convex shape across the path, the cutting edge including teeth that are aligned along the cutting edge such that the tips of the teeth extend generally downstream and together form the convex shape, such that the cutting edge engages and sequentially initiates cuts through the line of material when the line of dunnage is pulled against the cutting member, thereby reducing cutting forces, the tear-assist apparatus configured to operably pull the line of dunnage upstream against the cutting members to initiate the cuts.

20. The dunnage apparatus of claim 19, wherein the tear-assist unit and converting station comprise a drum that is operable for pulling the line of dunnage upstream with respect to the path against the cutting member to initiate the cuts.

21. The dunnage apparatus of claim 19, wherein the convex shape is an arc.

* * * * *